United States Patent [19]

Cox

[11] 4,126,810

[45] Nov. 21, 1978

[54] CERAMIC BASE FOR GLASS HALOGEN LAMPS

[75] Inventor: Charles W. Cox, Willoughby, Ohio

[73] Assignee: General Electric Company, Schenectady, N.Y.

[21] Appl. No.: 848,280

[22] Filed: Nov. 3, 1977

Related U.S. Application Data

[63] Continuation of Ser. No. 691,500, Jun. 1, 1976, abandoned.

[51] Int. Cl.[2] ..... H01J 5/48; H01J 5/50

[52] U.S. Cl. ..... 313/318; 313/315; 339/146

[58] Field of Search ..... 313/315, 318; 339/146

[56] References Cited

U.S. PATENT DOCUMENTS

| | | | |
|---|---|---|---|
| 2,101,277 | 12/1937 | Wappler | 339/146 |
| 2,627,048 | 1/1953 | Lamb | 313/318 |
| 3,077,022 | 2/1963 | Cullis | 313/318 |
| 3,798,491 | 3/1974 | Malm | 313/315 |
| 3,859,554 | 1/1975 | Preziosi et al. | 313/318 |
| 3,959,684 | 5/1976 | Anderson et al. | 313/315 |

*Primary Examiner*—Saxfield Chatmon, Jr.
*Attorney, Agent, or Firm*—Paul F. Wille; Lawrence R. Kempton; Frank L. Newhauser

[57] ABSTRACT

A ceramic base is added to a glass halogen lamp to improve the electrical performance and ease of use of the lamp.

8 Claims, 3 Drawing Figures

CERAMIC BASE FOR GLASS HALOGEN LAMPS

This is a continuation of application Ser. No. 691,500, filed June 1, 1976, now abandoned.

BACKGROUND OF THE INVENTION

This invention relates to glass halogen lamps and, in particular, to subminiature glass halogen lamps having a ceramic base.

In the prior art, the discovery of what is now known as the halogen cycle has substantially reduced the problem of bulb blackening due to evaporation of tungsten from the incandescent filament during the life of the lamp. While a variety of lamps have been introduced incorporating this discovery, producing different size lamps is not merely a matter of scale, i.e., changing the size of the envelope and filament. A lower limit on the size of the lamp was reached due to the need for metal foil in the seal interconnecting the inner and outer leads of the lamp. The foil was necessary because of the difference in temperature coefficient of expansion between the foil, usually comprising molybdenum, and the quartz envelope.

This problem was solved with the glass halogen lamp wherein the tungsten or molybdenum lead wires are brought directly through the seal without the use of a foil interconnection. Since the broad foil segments are obviated, the width of the seal becomes compatible with subminiature lamp sizes, i.e., lamps having an envelope diameter of 0.64 cm. (0.25 inches) or less. A more complete description of this lamp and its advantages is contained in U.S. Pat. No. 3,798,491.

While commercially well received, the use of the lamp has been somewhat restricted due to the difficulty some potential users have in handling the fine $2.5\times10^{-2}$ cm. (10 mil) molybdenum leads from the lamp. Welding the leads results in an undesirable, permanent connection. Soldering to molybdenum is rather difficult. In the past, the difficulty of electrically connecting the lamp to a power source was overcome by providing a two-pin ceramic base for the lamp, which had the added benefit of enabling the finished lamp to be prefocused. In this assembly, tubular pins are staked to a ceramic base shell. The wire lamp leads are inserted into the tubular pins and connected using a combination crimp-weld.

The pin staking operation limits the size of the base shell and pin space and is costly. The crimp-weld operation deforms the pins and often results in unsatisfactory electrical contact. In addition, pin length is restricted to the length of the pin being staked, requiring extensive inventories of bases for different lamp types.

SUMMARY OF THE INVENTION

In view of the foregoing, it is therefore an object of the present invention to provide a means for reliably connecting to a glass halogen lamp.

Another object of the present invention is to provide a single lamp type which will fit existing sockets requiring different pin lengths.

A further object of the present invention is to eliminate the staking operation in the manufacture of subminiature glass halogen lamps.

Another object of the present invention is to provide a glass halogen lamp which can be prefocused.

The foregoing objects are achieved in the present invention wherein two conductive pins having a larger diameter than the lamp leads are welded one each to a lamp lead and inserted into a base shell and potted so that the welds are enclosed and the pins and filament are located with respect to the base.

BRIEF DESCRIPTION OF THE DRAWINGS

A more complete understanding of the present invention can be obtained by considering the following detailed description in conjunction with the accompanying drawings, in which.

DESCRIPTION OF THE PREFERRED EMBODIMENTS

Figure 1:
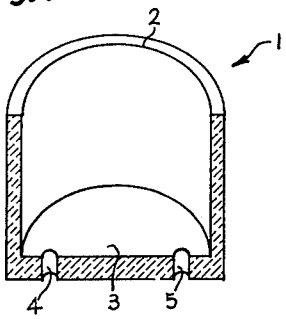
FIG. 1 illustrates the ceramic base shell in accordance with the present invention.
Figure 2:
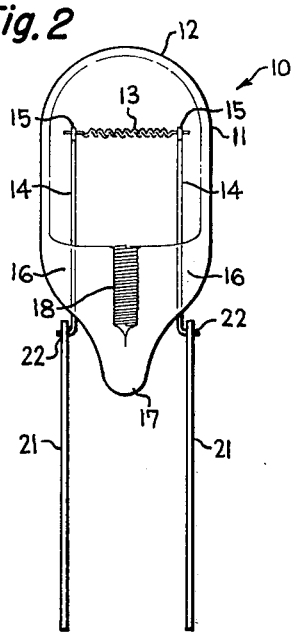
FIG. 2 illustrates the wire lamp subassembly in accordance with the present invention.

As illustrated in FIG. 1, ceramic base shell 1 preferably comprises a right circular cylinder having open end 2, and closed end 3 contains two apertures 4 and 5 through which the leads from the wire lamp described in FIG. 2 are inserted. While illustrated in FIG. 1 as containing two apertures, base shell 1 may comprise only one larger aperture through which all of the leads from the wire lamp pass. Ceramic base shell 1 may comprise any suitable material such as, by way of example only, L-3 grade steatite.

Referring to FIG. 2 of the drawings, lamp 10 has an envelope 11 with a rounded end 12. Rounded end 12 is preferably free of all irregularities and striations so that there is a minimum amount of distortion of the illumination of filament 13. Distortion-free light of this kind is required in certain applications, such as medical and optical examining instrument lighting because the pattern of illumination is critical in diagnosis. Envelope 11 may comprise any suitable hard (high melting point) glass such as the aluminosilicate glass described in the above-noted patent.

Tungsten filament 13 is attached to lead wires 14 by bending one end of the lead to form a hook or clamp as shown at location 15. In order to withstand the tungsten-halogen cycle and form a glass-to-metal seal, lead wires 14 are of a refractory metal such as molybdenum or tungsten. The lead wires are sealed to envelope 11 at area 16.

Located opposite rounded end 12 is tipped-off residue 17 of an exhaust tube. Contained within the tipped-off residue 17 is a spiral 18 of tungsten wire, which keeps the exhaust tube open to its full inside diameter during the lead wire sealing operation so that lamp 10 can be subsequently flushed and filled.

Lead wires 14 extend from the seal area 16 a short distance whereupon they are bent through a short radius to provide a contact length roughly orthogonal to conductive wires or pins 21 which, for example, may be welded to lead wires 14 at weld points 22. Conductive pins 21 may comprise any suitable conductive material having a corrosion-resistant surface such as nickel, nickel-plated iron or a nickel-iron alloy. In addition, pins 21 are a heavier gauge wire than that used for lead wires 14. For example, lead wires 14 typically comprise molybdenum wire having a diameter of $2.5\times10^{-2}$ cm. (10 mil), while conductive pins 21 comprise $7.1\times10^{-2}$ cm. (28 mil) nickel wire.

Figure 3:
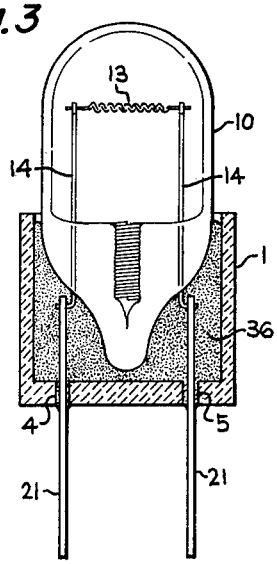
FIG. 3 illustrates a completed lamp in accordance with the present invention.

FIG. 3 illustrates an assembled lamp in accordance with the present invention wherein lamp 10 has been inserted into base 1 with pins 21 passing through apertures 4 and 5. The volume between lamp 10 and base 1 is then filled with a suitable cement or adhesive 36, such as sodium silicate or alumina phosphate based cements. Depending upon the application for the assembled lamp, filament 13 can be suitably aligned with respect to base 1 to provide a prefocused lamp. While it is preferred that cement 36 fill the volume between lamp 10 and base 1, it is only necessary that enough cement be utilized to seal each end of the base to hold lamp 10 and pins 21 in place. When base 1 contains a single aperture through which both of pins 21 pass, cement 36, in addition to bonding lamp 10 to base 1, serves as an electrical insulator and spacer separating pins 21. Cement 36 also acts to strengthen the contact structure for the lamp in holding pins 21 in place relative to lead wires 14 so that the welds are not broken during handling of the lamp. Pins 21 are sufficiently long so that only one type of lamp need be produced and that various pin lengths are obtained simply by trimming the pins to the customer's specifications, thereby eliminating the need to stock bases in several pin lengths.

There is thus provided by the present invention a glass halogen lamp having one base suitable for a variety of applications, compatible with existing sockets, and readily adapted to particular sockets simply by trimming the pins thereof. In addition, if desired, the lamp may be prefocused with respect to the base.

Having thus described the invention, it will be apparent to those of skill in the art that various modifications can be made within the spirit and scope of the present invention.

What I claim as new and desire to secure by Letters Patent of the United States is:

1. A subminiature glass halogen incandescent lamp comprising:

a subminiature hard glass envelope having a sealed end;

an atmosphere within said envelope comprising a halide;

refractory metal lead wires extending through said sealed end;

a filament connected to the ends of said lead wires contained within said envelope;

conductive wires joined one each to said lead wires at the ends extending from the sealed end of said envelope;

a ceramic base having an inside diameter greater than the outside diameter of said envelope, said ceramic base surrounding the sealed end of said envelope and the joint between said conductive wires and the respective lead wires, said conductive wires extending from said base, said filament being located at a predetermined position with respect to said base; and an adhesive filling at least the ends of said base to enclose the volume between said base and said envelope thereby securely holding said envelope and filament in said predetermined position and protecting said joint from mechanical stress and corrosion.

2. The lamp as set forth in claim 1 wherein said adhesive fills said volume.

3. The lamp as set forth in claim 2 wherein said base has a closed end with one aperture therein through which said conductive wires pass, and wherein said adhesive electrically insulates and holds in place said conductive wires.

4. The lamp as set forth in claim 2 wherein said ceramic base has a closed end with holes therein, said conductive wires passing one each through said holes.

5. The lamp as set forth in claim 1 wherein said conductive wires comprise a corrosion-resistant outer surface.

6. The lamp as set forth in claim 1 wherein said conductive wires have a larger diameter than said lead wires.

7. The lamp as set forth in claim 6 wherein said conductive wires have at least twice the diameter of said lead wires.

8. The lamp as set forth in claim 1 wherein said conductive wires are welded to said lead wires.

* * * * *